US005934515A

United States Patent [19]

Bennett

[11] Patent Number: 5,934,515

[45] Date of Patent: Aug. 10, 1999

[54] MULTI-ORIFICE MULTI-COMPARTMENT DISPENSER WITH CHILD-RESISTANT CLOSURE

[75] Inventor: Robert Alfread Bennett, Easton, Conn.

[73] Assignee: Chesebrough-Pond's USA Co., Division of Conopco, Inc., Greenwich, Conn.

[21] Appl. No.: 08/971,595

[22] Filed: Nov. 17, 1997

[51] Int. Cl.[6] ..... B67B 5/00

[52] U.S. Cl. ..... 222/153.14; 222/129; 222/524; 222/525

[58] Field of Search ..... 222/129, 34, 519, 222/524, 525, 153.1, 153.14

[56] References Cited

U.S. PATENT DOCUMENTS

| | | | |
|---|---|---|---|
| 3,729,553 | 4/1973 | Gold et al. | 222/94 |
| 3,885,712 | 5/1975 | Libit | 222/153 |
| 4,022,352 | 5/1977 | Pehr . | |
| 4,127,221 | 11/1978 | Vere . | |
| 4,244,495 | 1/1981 | Lorscheid et al. . | |
| 4,687,663 | 8/1987 | Schaeffer . | |
| 4,852,770 | 8/1989 | Sledge et al. . | |
| 4,884,703 | 12/1989 | O'Meara | 222/94 X |
| 4,925,041 | 5/1990 | Pehr . | |
| 5,137,260 | 8/1992 | Pehr . | |
| 5,252,312 | 10/1993 | Gentile et al. . | |
| 5,289,950 | 3/1994 | Gentile . | |
| 5,356,017 | 10/1994 | Rohr et al. . | |
| 5,392,947 | 2/1995 | Gentile | 222/129 X |
| 5,573,143 | 11/1996 | Deardurff et al. | 222/153.14 |
| 5,579,957 | 12/1996 | Gentile et al. . | |
| 5,611,463 | 3/1997 | Favre | 222/137 |
| 5,653,361 | 8/1997 | Favre | 222/129 |

*Primary Examiner*—Andres Kashnikow
*Assistant Examiner*—David Deal
*Attorney, Agent, or Firm*—Milton L. Honig

[57] ABSTRACT

A dispensing package is provided including a container with at least two discrete compartments, respective closures positioned across upper outlet ends of the compartments and a cap fitting over the respective closures. The cap includes a crown with a surrounding skirt. The skirt has at least two flexibly squeezable sides with catches formed on the skirt lockingly engageable over the closures. The crown further includes dispensing orifices for each of the outlet orifices and in an open position allows fluid dispensing from the compartments. By placing pressure on side panels of the cap, the catch can be released, lifted into a dispensing position and fluid poured from each of the respective compartments without any intermixing within the dispensing package or cross-contamination on drain back.

7 Claims, 2 Drawing Sheets

MULTI-ORIFICE MULTI-COMPARTMENT DISPENSER WITH CHILD-RESISTANT CLOSURE

BACKGROUND OF THE INVENTION

1. Field of the Invention

The invention concerns a multi-orifice multi-compartment dispenser with child resistant closure.

2. The Related Art

Simultaneous dispensing systems for two or more liquids from different chambers of a multi-chambered dispenser are extremely difficult to engineer. Packaging of this variety has been necessary for cosmetic, detergent, medical and other product delivery systems. Of particular interest has been a dispenser for effervescent mouthwash to separate during storage antagonistically reactive chemicals. For instance, separation is required of peroxide and baking soda, which when combined prior to use have been recognized as an effective composition for oral hygiene.

Illustrative of multi-compartment dispensing systems is U.S. Pat. No. 3,729,533 (Gold) which discloses an effervescent composition packaged in a two-compartment container. The first of these compartments is intended to store an alkaline solution such as aqueous sodium bicarbonate. The second of the compartments is intended to store an acid solution. During storage, each of the components are maintained separate from one another to prevent premature reaction. Upon dispensing, the components mix and thereby release carbon dioxide.

U.S. Pat. No. 4,687,663 (Schaeffer) describes a toothpaste having semi-solid bicarbonate and semi-solid hydrogen peroxide-containing components, each extruded from separate compartments and placed in contact on a toothbrush. When the brush is applied to teeth and gums, immediate mixing of the components occurs with rapid evolution of oxygen and carbon dioxide. The combination of the ingredients is believed to kill bacteria responsible for gum disease.

U.S. Pat. No. 5,154,917 (Ibraham et al.) reports a mouthrinse product comprising a multi-compartment bottle with each compartment storing a liquid of different color. One of the liquids is alkaline containing sodium bicarbonate/carbonate. A second of the liquids is an acidic solution formed of citric acid. These red and blue liquids, respectively, upon dispensing from the bottle combine to form a liquid admixture of yet another color.

In U.S. Pat. No. 5,289,950 and U.S. Pat. No. 5,252,312 there is disclosed a packaged effervescible composition containing sodium bicarbonate and hydrogen peroxide, each in separate compartments of a dual-compartment dispenser. The dispenser includes a closure system comprising an inclined crown portion, at least two pouring spouts extending upwardly from an upper surface of the crown portion and a cover for securement to the crown portion. The cover is provided with depending plugs to seal the closure. Each pouring spout is preferably provided with a vent opening in addition to product orifices in the spouts. The orifices are positioned close together on the crown to assist in controlling pouring.

Among problems of the aforementioned art is the tendency of one or a mixture of the components to drain back into the compartments and thereby spoil the contents. Secondly, the user of the package is given insufficient visual guidance on how to dispense the components from the package. As a result, unwanted premature mixing of materials may occur during pouring. For instance, this leads to reaction of the hydrogen peroxide and sodium bicarbonate outside of the mouth with no beneficial oxygen evolution. Thirdly, known packaging for dispensing from a multi-compartment dispenser is not adapted for uniform pouring of the components into small-mouth cups of the type typically used for mouthwash.

Still further obstacles have been encountered in developing packaging for certain types of liquid products. Compositions to be dispensed which require alcohol or other potentially dangerous ingredients are required by government regulations to be fitted with childproof packaging. It is the intent of these regulations to avoid accidental poisoning or injuring of young unattended children sampling the products.

Engineering a child-resistant closure presents many challenges. Not only must the safety device hinder opening by a child but it must nevertheless be openable by adults having limited manual dexterity. Access must be designed for the older group who may be suffering from arthritis, age-induced loss of strength or other causes lessening their dexterity. Simply stated, an engineer is presented with an extremely tight performance brief.

The literature has recorded a variety of child-resistant closure systems. For instance, U.S. Pat. No. 4,852,770 (Sledge et al.) describes a closure having a base portion and a cap hingedly connected thereto. An elongated, flexible, resilient post extends upwardly from the base with an enlarged upper end. When the cap is brought towards a closed position, the elongated upper end passes though an aperture in the cap top wall and assumes an orientation which interferes with opening of the cap. A similar concept is described in each of U.S. Pat. No. 4,127,221 (Vere), U.S. Pat. No. 5,137,260 (Pehr), U.S. Pat. No. 5,356,017 (Rohr) and U.S. Pat. No. 4,925,041 (Pehr) wherein a flexible upright locking lever or tongue is tensioned to fit through an opening in a covering cap.

Another approach is illustrated in U.S. Pat. No. 4,022,352 (Pehr) and U.S. Pat. No. 4,244,495 (Lorscheid et al.). These patents employ a cap or lid hingedly attached to a base. A resilient latch or tongue formed on the cap or lid is oriented downwardly to retainingly engage a cooperating latching device formed in the base.

A problem with many of the known devices is that they are either insufficiently childproof or too difficult for an older adult to open. Another problem is that some of the devices are insufficiently liquid leak proof, the result of which causes product spillage during shipping and handling.

Accordingly, it is an object of the present invention to provide a multi-compartment dispenser which not only separates mutually antagonistic reactive ingredients but also upon completion of dispensing ensures drain back of each ingredient into its respective compartment without mixing with one another.

Yet another object of the present invention is to provide a multi-compartment dispenser adapted for uniform pouring of the components into small-mouth cups of a type typically utilized for mouthwash.

A further object of the present invention is to provide a multi-compartment dispenser with a child-resistant closure which passes government standards.

Yet a further object of the present invention is to provide a multi-compartment dispenser with a child-resistant closure that seals sufficiently to prevent product leakage during shipping and handling.

SUMMARY OF THE INVENTION

A dispensing container is provided which includes:

a container having at least two discrete compartments each with an upper outlet end;

a respective closure positioned across the upper outlet end of each compartment, the closure having an outlet orifice for each of the compartments; and a cap fitting over the respective closures, the cap having a crown portion and a skirt surrounding the crown portion, the skirt having at least two flexibly squeezable sides and a catch formed on the skirt, the skirt being lockingly engageable over the closures, the crown having dispensing orifices for each of the outlet orifices and in an open position allowing fluid dispensing from the compartments.

DETAILED DESCRIPTION OF THE DRAWINGS

The present invention will better be understood from the following detailed description in conjunction with an accompanying drawing in which.

DETAILED DESCRIPTION OF THE INVENTION

Now there has been developed a multi-compartment pouring dispenser with multiple orifices to simultaneously deliver two compositions which have been held separate to avoid pre-mixing until after they are dispensed. Furthermore, the dispensing package is child resistant and allows air to vent into the container while pouring, thereby maintaining steady flow.

Figure 1:
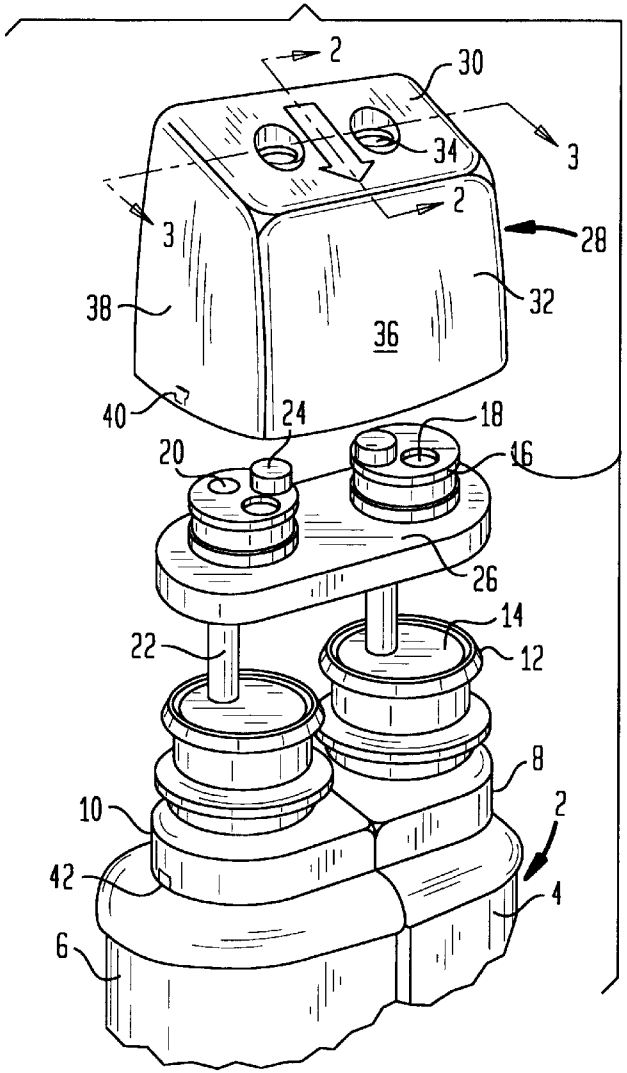
FIG. 1 is an exploded view of the dispensing package with the container, closure and cap being shown in a separated manner.

FIG. 1 illustrates the main elements of the dispensing package. These include a container 2 with a first and second compartment 4, 6 with each having a respective neck 8, 10. An upper outlet end 12 is defined by an open mouth 14 of each neck 8, 10.

A closure 16 is positioned across the upper outlet end 12 of each compartment. An outlet orifice 18 is provided on an upper surface of each respective closure. Adjacent each outlet orifice is a vent aperture 20 leading through a downwardly projecting vent pipe 22 into container 2. Astride the outlet orifice and vent aperture is an upwardly projecting plug 24. The respective closures 16 in the preferred embodiment are joined together through a platform 26.

In an alternate embodiment the closures may be integrated with the platform so that a major surface of the platform instead of raised areas 16, is formed with the respective outlet orifices, vent apertures and plugs. In a still further embodiment, the closures and platform may be integrally molded with the container.

A cap 28 is fitted over the respective closures 16. The cap includes a crown 30 and a skirt 32 surrounding the crown. Dispensing orifices 34 are formed in the crown for each of the corresponding outlet orifices 18. Skirt 32 has at least flexible front and rear panels 36 as well as flexible side panels 38. Along the side panels 38 of skirt 32, at a lower edge thereof is an inwardly projecting hook-shaped catch 40.

Figure 3:
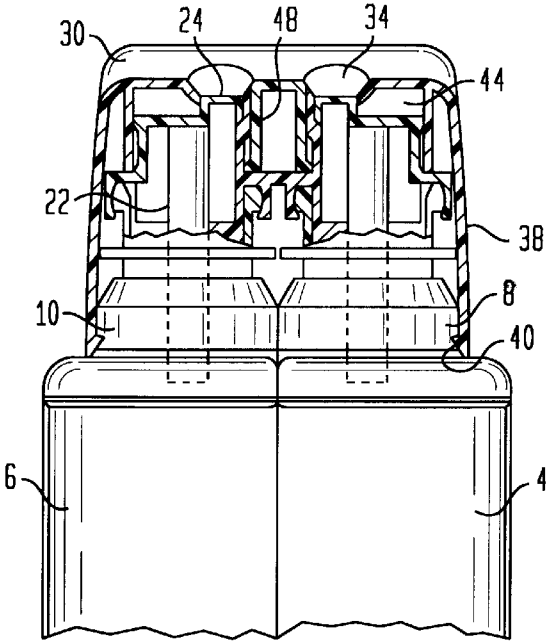
FIG. 3 is a cross-sectional view along lines 3—3 of FIG. 1, with the container only partially shown.
Figure 4:
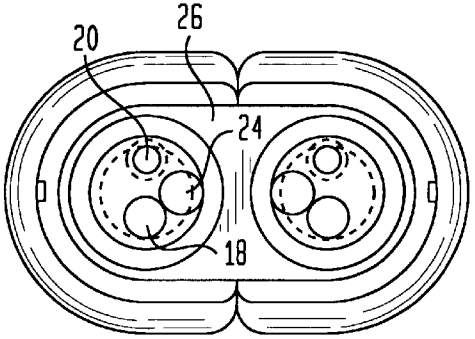
FIG. 4 is a top plan view of the dispensing package with the cap removed.
Figure 2:
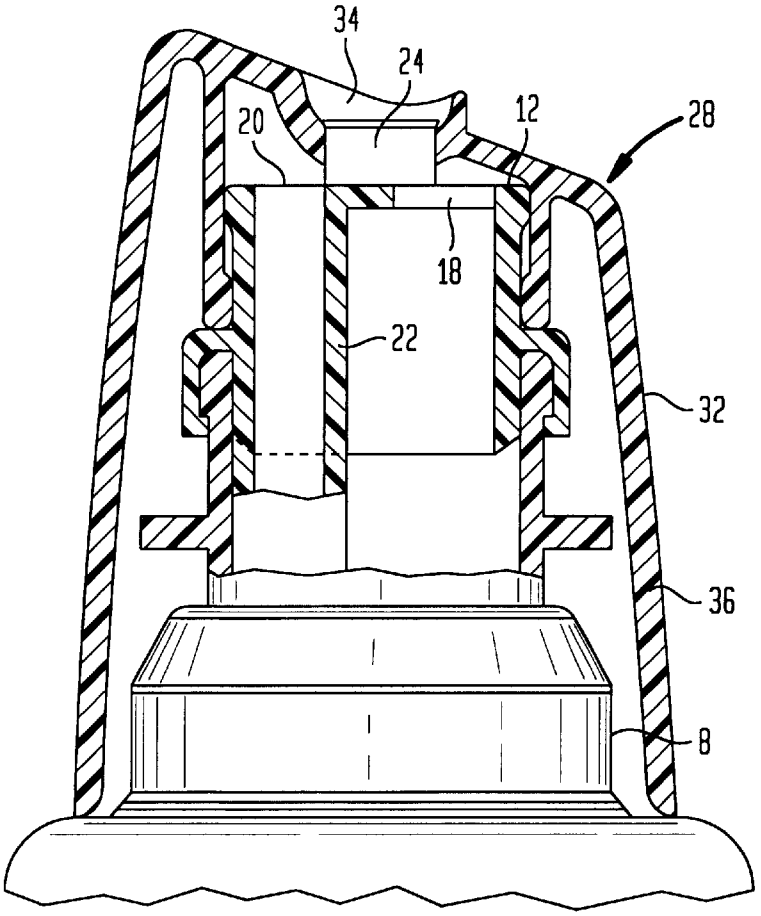
FIG. 2 is a cross-sectional view through lines 2—2 of FIG. 1, with the container only partially shown.

FIG. 2 and FIG. 3 illustrate a closed position of the dispensing package. In this position, the cap 28 is pushed downward over the closure sufficient to insert plugs 24 in their respective dispensing orifices 34. By this arrangement the plugs seal any flow outward from the compartments of the container. Child-proofing is achieved by catch 40 seating into undercut 42 formed along a respective neck of the container. Disengagement of the catch requires squeezable manipulation against flexible side panels 38 resulting in the outward bowing of the front and rear panels 36.

Figure 5:
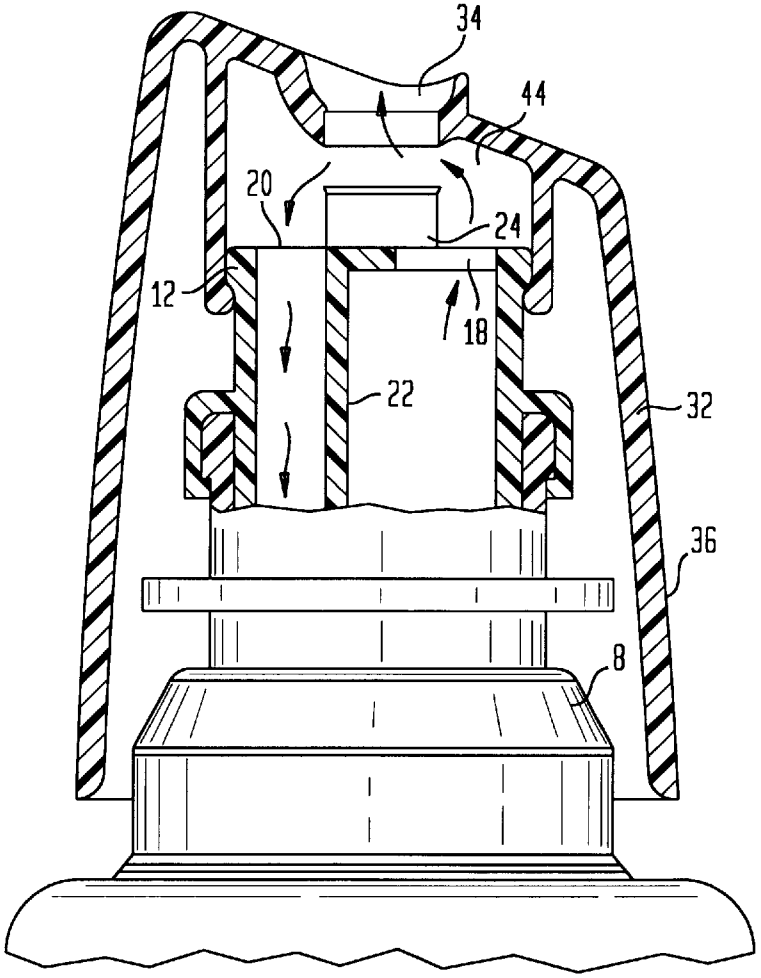
FIG. 5 is a cross-sectional view similar to that of FIG. 2 except illustrating the cap in an open fluid dispensing position.

FIG. 5 illustrates the package in a dispensing position. Cap 28 is shifted upwards after the squeezable release of catch 40 from undercut 42. As a result of the upward displacement, plug 24 is disengaged from its snug fit within dispensing orifice 34. Upon tilting the package, fluid is able to flow from the respective compartments through respective outlet orifices 18, through chamber 44 and outward through dispensing orifice 34. Chamber 44 is bounded by internal surfaces of the cap including divider 48 separating closures and external surfaces of the closure. Any excess flow is returned from chamber 44 downward into either vent aperture 20 or outlet orifice 18. Further prevention of any intermixing of flow into adjacent chambers is prevented by the downwardly sloping inclined surface of the crown.

It will be readily observed from the foregoing detailed description and embodiments that numerous variations and modifications may be effected without departing from the spirit and purview of the present invention.

What is claimed is:

1. A dispensing package comprising:

a container having at least two discrete compartments each with an upper outlet end;

a respective closure positioned across the upper outlet end of each compartment, the closure having an outlet orifice for each of the compartments; and a cap fitting over the respective closures, the cap having a crown portion and a skirt surrounding the crown portion, the skirt having at least two flexibly squeezable sides and a catch formed on the skirt, the skirt being lockingly engageable over the closures, the crown having dispensing orifices for each of the outlet orifices and in an open position allowing fluid dispensing from the compartments, the respective dispensing orifices being laterally displaced from a longitudinal axis passing through a center of the respective outlet orifices.

2. The package according to claim 1 further comprising for each of the respective closures a plug projecting upwards from the crown, the plugs being insertable into the dispensing orifices when the cap is in a closed position thereby sealing fluid flow.

3. The package according to claim 1 wherein the respective closures are integrally connected to one another along a common platform.

4. The package according to claim 1 wherein the crown is downwardly inclined.

5. The package according to claim 1 wherein the catch is a hook-shaped inwardly projecting wedge.

6. The package according to claim 1 wherein the container compartments have respective necks leading to the respective closures.

7. The package according to claim 6 further comprising an undercut along the respective necks against which the catch lockingly seals.

* * * * *